US005224281A

United States Patent [19]

Nerrinck et al.

[11] Patent Number: 5,224,281

[45] Date of Patent: Jul. 6, 1993

[54] REAR ENTRY SKI BOOT

[75] Inventors: Bernard Nerrinck, La Balme de Sillingy; Philippe Billet, Annecy le Vieux; Jean-Marie Begey, Bonne, all of France

[73] Assignee: Salomon S.A., Annecy Cedex, France

[21] Appl. No.: 646,372

[22] Filed: Jan. 28, 1991

[30] Foreign Application Priority Data

Jan. 26, 1990 [FR] France ..... 90 01101

[51] Int. Cl.[5] ..... A43B 5/04

[52] U.S. Cl. ..... 36/121; 36/120

[58] Field of Search ..... 36/117, 118, 119, 120, 36/121

[56] References Cited

U.S. PATENT DOCUMENTS

| | | | |
|---|---|---|---|
| 3,735,508 | 5/1973 | Gertsch et al. | 36/121 |
| 4,085,528 | 4/1978 | Delery | 36/121 |
| 4,125,274 | 11/1978 | Kubelka et al. | 36/117 X |
| 4,179,827 | 12/1979 | Vaccari | 36/119 |
| 4,574,499 | 3/1986 | Olivieri | 36/117 |
| 4,882,857 | 11/1989 | Sartor et al. | 36/120 |
| 4,885,850 | 12/1989 | Sartor et al. | 36/119 |
| 4,905,385 | 3/1990 | Perrissoud | 36/120 |
| 4,910,888 | 3/1990 | Perrissoud | 36/117 |
| 4,918,842 | 4/1990 | Lederer | 36/117 |
| 4,928,408 | 5/1990 | Baggio et al. | 36/119 |
| 4,934,074 | 6/1990 | Sartor | 36/117 X |
| 4,944,100 | 7/1990 | Sartor et al. | 36/120 |
| 5,031,341 | 7/1991 | Paris et al. | 36/120 X |
| 5,065,533 | 11/1991 | Paris | 36/117 |

FOREIGN PATENT DOCUMENTS

| | | | |
|---|---|---|---|
| 1963342 | 6/1971 | Fed. Rep. of Germany . | |
| 2317408 | 10/1973 | Fed. Rep. of Germany . | |
| 2617380 | 1/1989 | France | 36/117 |
| 2619684 | 3/1989 | France . | |
| 2619999 | 3/1989 | France . | |

*Primary Examiner*—Steven N. Meyers
*Assistant Examiner*—BethAnne Cicconi
*Attorney, Agent, or Firm*—Sandler Greenblum & Bernstein

[57] ABSTRACT

An alpine ski boot having a shell base on which an upper is journalled. The upper includes a rear spoiler that is pivotally mounted about a transverse axis located at the rear portion of the shell base. The boot also includes a stirrup that is journalled on the shell base in the area of the ankle. The stirrup extends to the area of the heel, where it is connected to the rear spoiler, forming a connection with the rear spoiler, with respect to the shell base.

26 Claims, 7 Drawing Sheets

FIG: 12
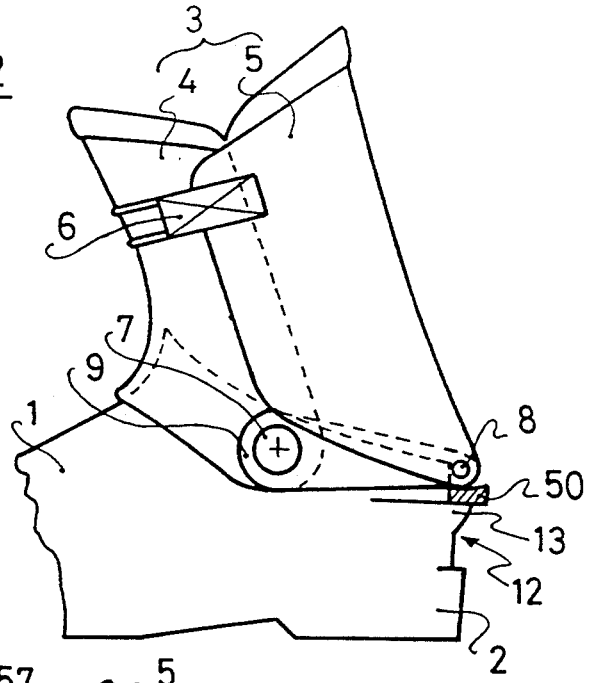
FIG: 13
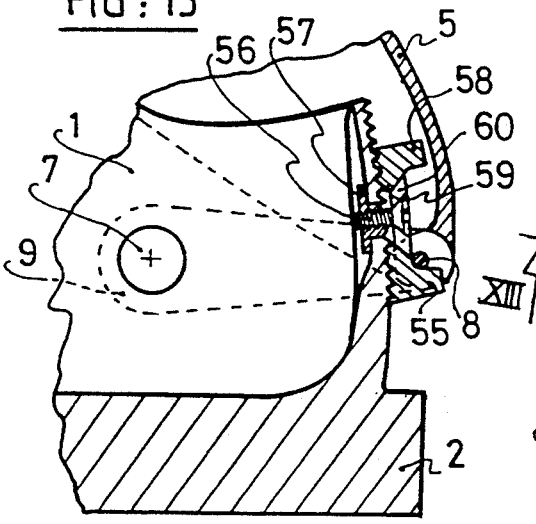
FIG: 13a
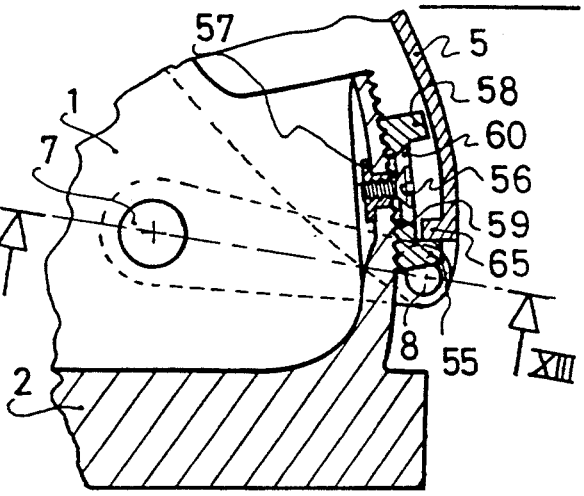
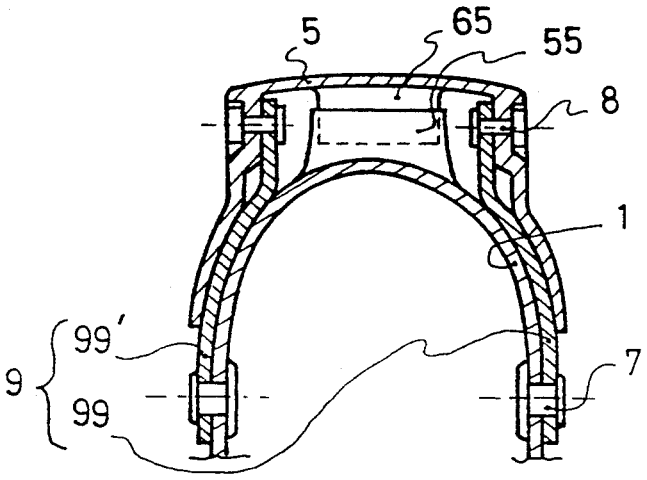
FIG: 13 b

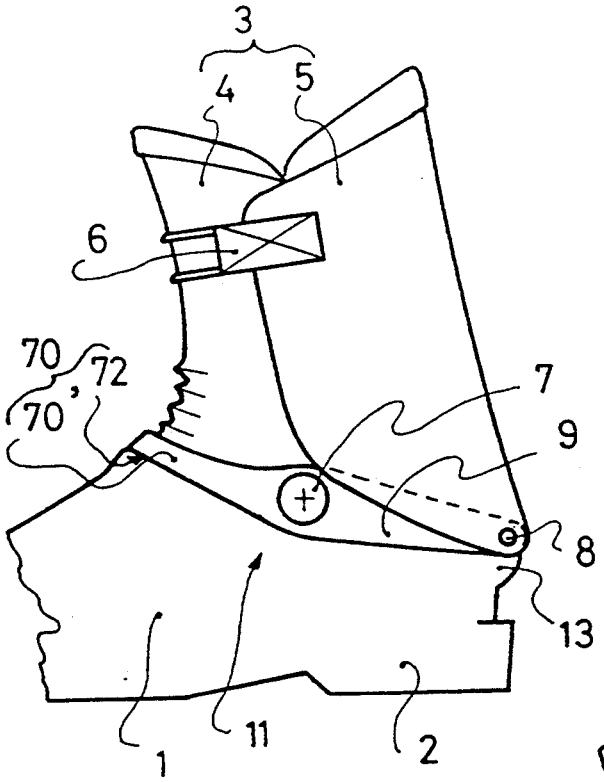
FIG: 14
FIG: 16
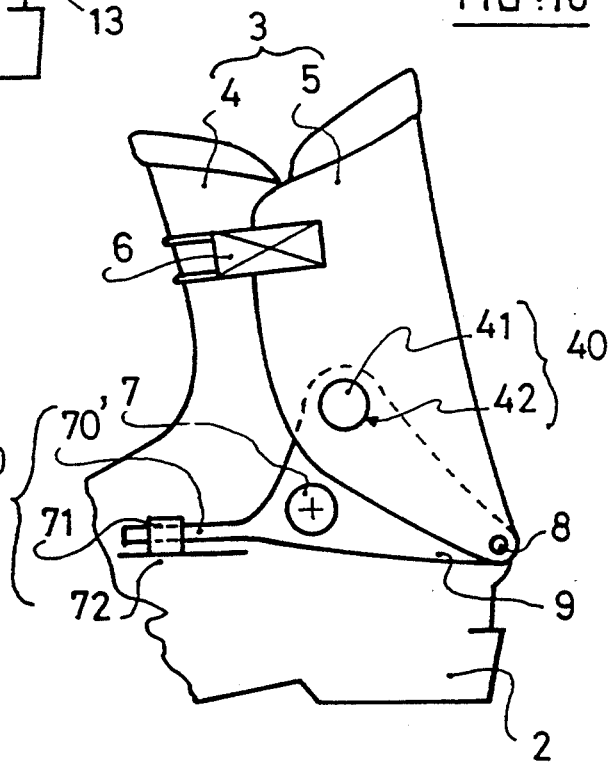
FIG: 15
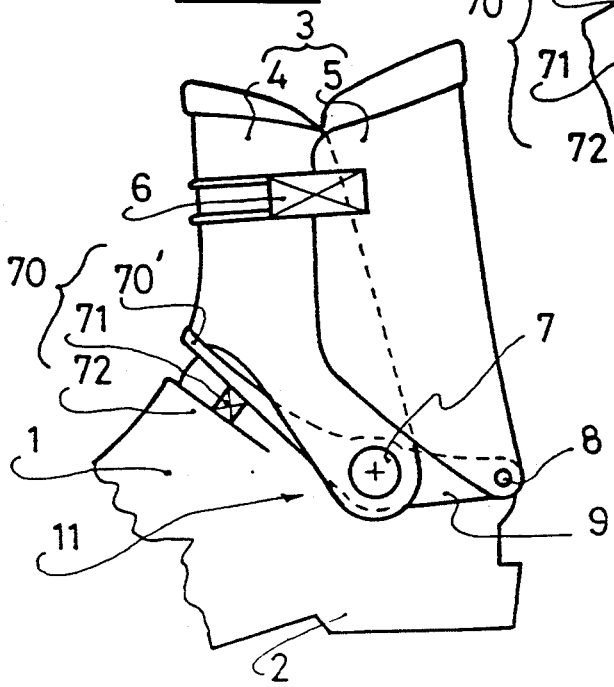

REAR ENTRY SKI BOOT

BACKGROUND OF THE INVENTION

1. Field of the Invention

The present invention is related to alpine ski boots whose upper is at least partially journalled with respect to the shell base and relates in particular to ski boots of the type wherein the foot is inserted from the rear comprising a rear spoiler mounted pivotably around a transverse axis positioned in the rear zone of the shell base.

2. Description of Background and Relevant Information

Known alpine ski boots of this type, such as those described in German Patent Publication 2,317,408 and German Patent Publication 1,963,342 have an upper comprising a front cuff and a rear spoiler which, secured by means of reciprocal maintenance, surround the lower leg of the skier and assure its retention in the boot. In these boots the rear spoiler has its pivot axis mounted on the rear end portion of the shell base, at the rear and at a distance from the journal zone corresponding to the ankle of the foot of the skier and independently of the front cuff of the upper. Such an arrangement of the rear spoiler makes it possible to substantially disengage the entire rear portion of the upper by moving the rear spoiler toward the rear and thus to facilitate the introduction insertion and removal of the foot of the skier from the boot.

However, during a flexion of the upper forwardly, the rear spoiler of these known boots pivots around its axis on the shell base without being able to follow the movement of the lower leg which, itself, pivots around the journal of the ankle. There results a relative sliding of the rear portion of the lower leg of the skier with respect to the rear spoiler, at each forward flexion and during the return to the initial position. This sliding, which occurs between the rear spoiler and the lower leg, is thus adapted to cause repeated friction which are found to be bothersome, even painful to the skier.

Other alpine ski boots of the type taught in French Patent Publication 2,619,999 alleviate this type of inconvenience by proposing in particular to journal the rear spoiler around an axis affixed to the shell base. To this end, a first journal axis is positioned in the journal zone of the upper and a second axis serving for opening the rear spoiler is positioned in the zone of the heel. On the other hand, particular linkage means used between the rear spoiler and its opening axis positioned on the shell base allow the rear spoiler to displace to the location of its opening axis in a direction which is substantially vertical and concentric to the journal axis of the upper, when the upper pivots in its entirety around its journal axis. This type of boot construction, while satisfactory on the functional level, has however a relatively complex structure to put into operation by virtue of the double function which the linkage of the rear spoiler on the shell base must serve, namely, pivoting upon opening and translational displacement during flexion of the upper during skiing.

SUMMARY OF THE INVENTION

The present invention proposes an alpine ski boot for which the rear spoiler of the upper is journalled in the zone of the heel of the boot on a stirrup which is distinct from the shell, itself journalled on the shell so as to assure a reinforced rigidity of the upper, during skiing conditions, while allowing for an optimum opening displacement towards the rear.

An object of the present invention is to provide a rear entry ski boot for which rear support forces are directly transmitted to the shell base by means of the rigidification stirrup of the upper.

Another object of the invention comprises providing a ski boot upper which opens to the rear and whose rigidification stirrup distinct from the upper is adapted, as required, to receive latching means of the rear spoiler with respect to the shell base.

The alpine ski boot according to the invention comprises an upper of which one portion at least is journalled with respect to the shell base This upper comprises a rear spoiler pivotably mounted around a transverse axis situated in the rear zone (or heel) of the shell base, wherein the rear spoiler is journalled with respect to the shell base on an element in the form of a stirrup which is itself journalled on the shell base generally at the level of the malleoli and extending on the sides of the shell base approximately from the zone corresponding to the journal position of the ankle until the zone of the heel. One of the two axes connects to the shell base in the journal zone of the ankle while the other axis connects the stirrup to the rear spoiler in the zone of the heel and thus constitutes the opening axis of the rear spoiler.

According to one characteristic of the invention, the stirrup is prevented from any rotation towards the rear and towards the bottom of the boot from a lower limit defining the opening axis of the rear spoiler in a lower "foot insertion-removal" position. To this end, the shell base is provided with a support element positioned in the zone of the heel, the support element cooperating with the stirrup when the stirrup pivots in the up-down direction during rear support movements of the leg, for example.

Likewise, still according to the invention, the boot comprises reciprocal retention means of the rear spoiler with respect to the front portion of the upper and/or with respect to the stirrup. These retention means are adapted to block the rear spoiler in the closure position of the upper, in association with the closure means of the latter.

Furthermore, according to complementary provisions, the boot of the invention comprises a stirrup of which at least one of its two linkage axes is adjustable in position in the vertical direction with respect to the support element positioned in the zone of the heel.

Finally, the retention means of the rear spoiler on the front portion of the upper and/or the stirrup are also made adjustable to different positions. This requires a modification of the angular position of the rear spoiler around its opening axis and consequently with respect to the stirrup.

BRIEF DESCRIPTION OF THE DRAWINGS

The invention will become clear and will be better understood with reference to the next schematic drawings illustrating, by way of non-limiting example only, various embodiments of the ski boot according to the invention in which:

FIG. 1 illustrates the boot in the initial position for skiing;

FIG. 2 illustrates the ski boot in the forward flexion positions such as during skiing;

FIG. 3 illustrates the boot in the foot insertion and removal positions;

FIGS. 12–13*b* each show an adjustment apparatus for adjusting the inclination position of the stirrup with respect to the shell base of a boot according to the invention;

FIGS. 14–19 schematically illustrate various embodiments of the pivot and rigidification stirrup of the rear spoiler, and in particular embodiments in which the stirrup comprises means for controlling the frontward flexion of the upper with respect to the shell base.

DESCRIPTION OF PREFERRED EMBODIMENTS

Figure 1:
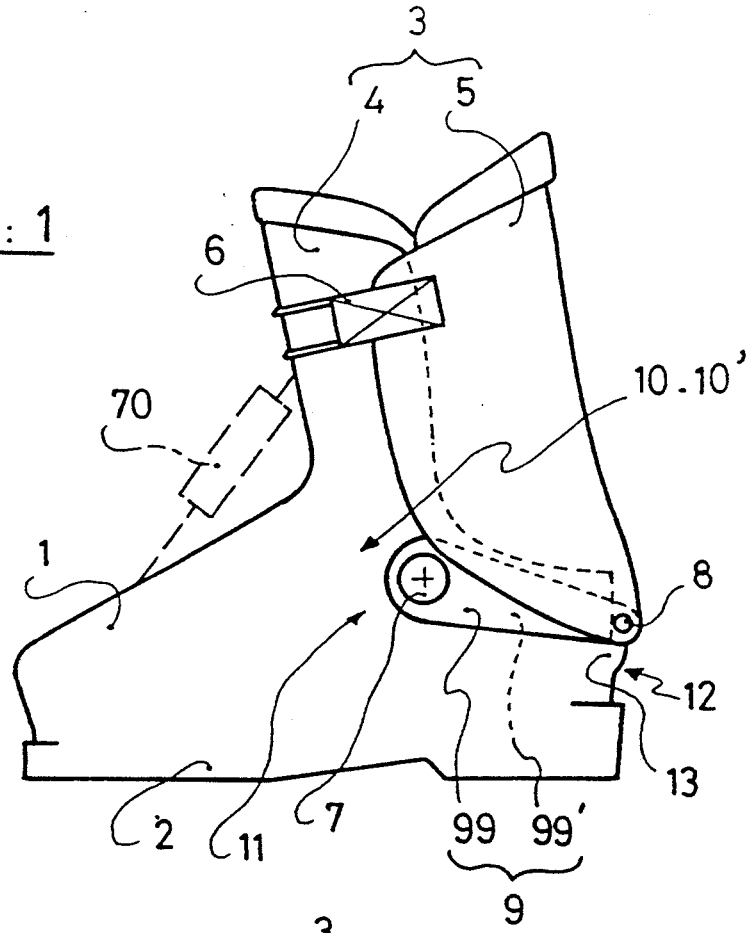
FIGS. 1–3 schematically illustrate, in elevational view, a ski boot comprising a double journal of the rear spoiler with respect to the shell base, constituted by means of a pivot and rigidification stirrup of the upper according to the invention.
Figure 2:
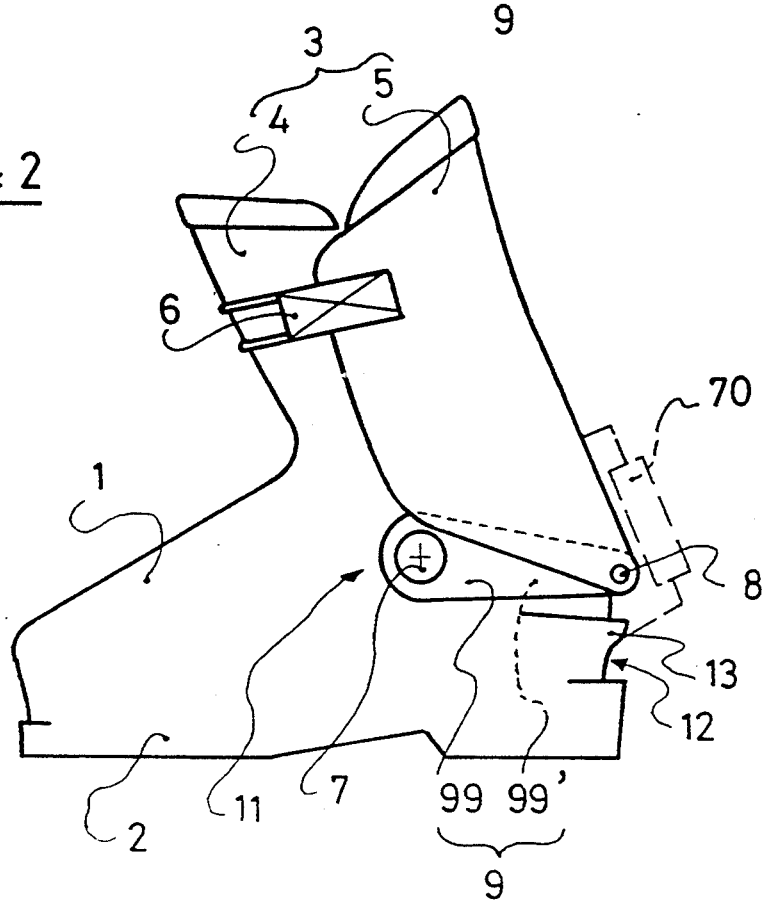
Figure 3:
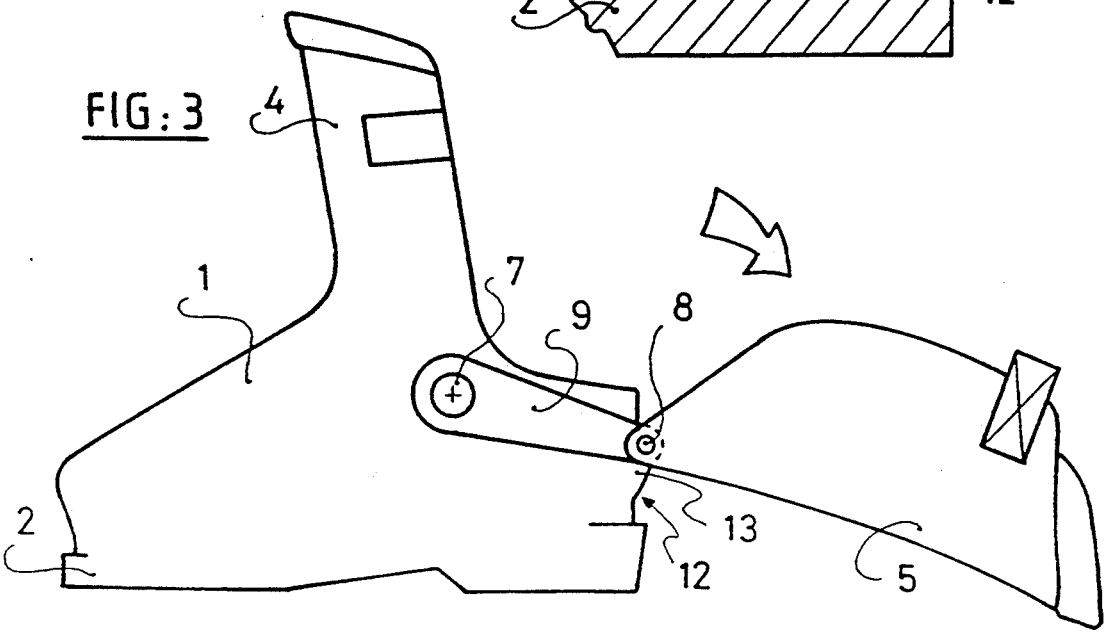

The ski boot shown in FIGS. 1–3 has a shell base 1 provided with a sole 2 and an upper 3 constituted by a front portion 4, or front spoiler or front cuff, and a rear portion 5, or rear spoiler. This upper is tightened on the lower leg of the skier for skiing by means of closure means 6 taken, from a type known in the state of the art, for example "buckles-teeth", "cable stretcher" etc.

According to the invention, the rear spoiler 5 is pivotably mounted with respect to the shell base 1 around two distinct axes 7–8 provided on an element 9 in the form of a stirrup which extends on the sides 10–10', of shell base 1 substantially from the zone 11 corresponding to the journal axis of the ankle until the zone of the heel 12. Stirrup 9 is constituted by two sides 99–99' which are adjacent to sides 10–10' of the shell base 1 and which are connected between them in the zone of heel 12 by means of an axis 8 on which the rear spoiler 5 pivots. A journal axis 7 connecting stirrup 9 to shell base 1 is constituted by two rivets positioned respectively on the sides of the shell in the journal axis 11 of the ankle. The other axis 8 connecting stirrup 9 to rear spoiler 5 in the zone of heel 12 constitutes the opening axis of the rear spoiler. Stirrup 9 is freely mounted to pivot upwardly and frontwardly of the boot around its linkage axis 7 from a "low" position in which the opening axis 8 of rear spoiler 5 is closest to sole 2. In the "low" position, stirrup 9 abuts, through its rear end zone, against a support element 13 constituted by an edge obtained on shell base 1 as is visible in FIG. 1, and an opening of upper 3 by release of the closure means 6 can then occur through rearward movement of rear spoiler 5 around its opening axis 8 as is shown in FIG. 3.

Figure 2A:
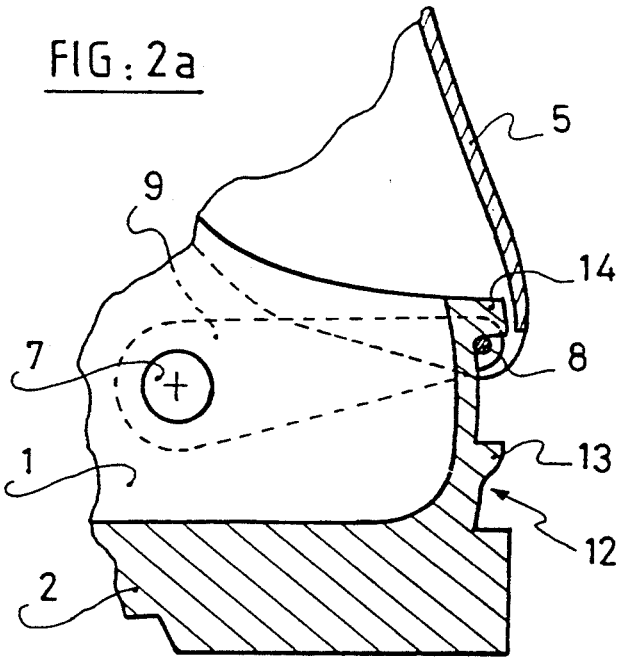
FIGS. 2*a* and 2*b* are vertical and longitudinal cross-sectional views of the ski boot of FIG. 2 showing two embodiments of the zone of the heel of the latter.

Likewise, as is shown in FIG. 1, the abutment position of stirrup 9 on support element 13 of shell base 1, upper 3 can flex forwardly, moving during its own movement the rear spoiler 5 by means of closure means 6. Rear spoiler 5 thus pivots around its front linkage axis 7 positioned generally in the zone of the malleoli of the skier while its rear opening axis 8 of the spoiler lifts above the zone of heel 12 and concentric to the linkage axis 7 such as is illustrated in FIG. 2. It is to be understood that this possibility of movement of forward flexion and/or return to the initial position of the rear spoiler 5 can be subjected to an apparatus of a known type for controlling the flexion shown schematically in the present case by reference 70. This apparatus can, as desired, interact between the front portion 4 and shell base 1 (FIG. 1) or the rear spoiler 5 and shell base 1 (FIG. 2). Furthermore, the amplitude of pivoting towards the front of the rear spoiler 5 can be determined by the front portion 4 (front cuff or spoiler) or be limited at will by means of a stop element interacting either between the rear spoiler and the shell base, or between the stirrup and the shell base. In the case of FIG. 2*a*, shell base 1 is provided with a stop element 14 in the zone of heel 12 constituted by an edge made of one piece with its wall and against which abuts, in the frontward pivoting position, linkage axis 8 of stirrup 9 with rear spoiler 5. This stop element 14 is, in this embodiment affixed in position and, as a consequence, the free space between the latter and the support element 13 defines the maximum amplitude of pivoting of stirrup 9 around its front axis 7.

Figure 2B:
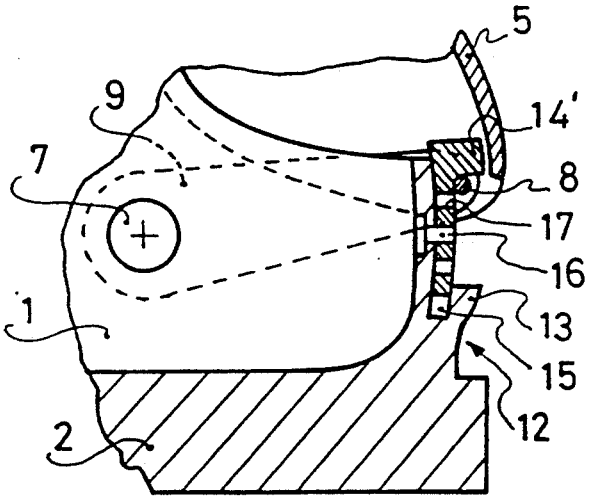

Furthermore, according to the embodiment illustrated in FIG. 2*b*, stop element 14' is made independent of the wall of shell base 1 and is made adjustable in position thereon through sliding in a guide 15 and a series of teeth 17 with which cooperate a latching finger 16. It is thus easy to vary the position of finger 16 in any of the teeth 17 so as to vary the amplitude of movement of stirrup 9 when it pivots around its front axis 7, and consequently the amplitude of vertical movement of rear spoiler 5.

Still according to the invention, and in particular so as to assure the simultaneous flexion of the two spoilers 4 and 5 of upper 3 during skiing, means for blocking pivoting of the rear spoiler with respect to the front portion 4 of the upper can preferably be associated and/or cooperate with the closure means 6 of the upper.

Figure 4:
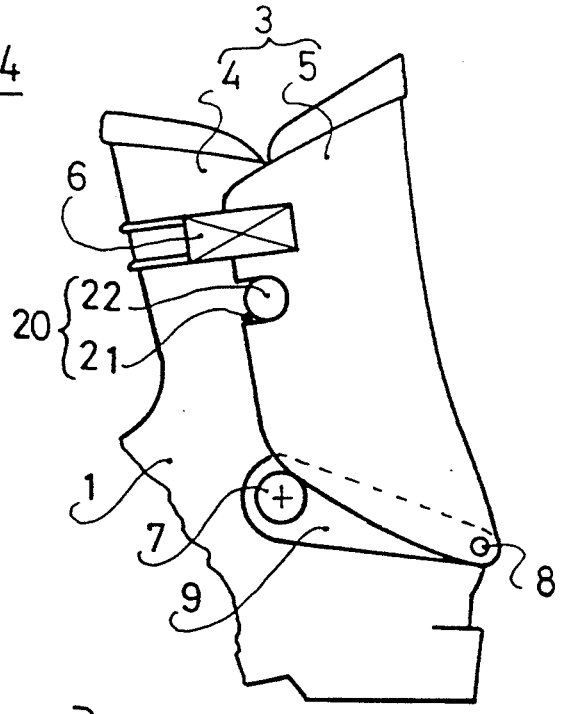
FIGS. 4–8 illustrate various means for blocking pivoting on the stirrup of the rear spoiler towards the front portion of the upper in the closed position.

In the embodiment shown in FIG. 4, such blockage means 20 comprise a plug 22 which projects with respect to front spoiler 4 and through a corresponding cut-out 21 provided in wing 23 of rear spoiler 5. Plug 22 and cut-out 21 are preferably positioned in the proximity of the closure means 6 of the upper to perfect the rigidity of the linkage of the two spoilers. As is seen, the blockage means 20, in cooperation with the closure means 6, function to block the rear spoiler 5 in the skiing position and to prevent in particular any relative displacement of rear spoiler 5 with respect to front spoiler 4 when the upper assembly flexes. Furthermore, by virtue of the fact that rear spoiler 5 is likewise prevented from any downward displacement at the level of its opening axis 8 when stirrup 9 rests on edge 13 of the shell base, these blockage means 20 define the angular closure position of rear spoiler 5 with respect to shell base 1, and thus the angle of inclination of upper 3 in the initial skiing position.

Figure 5:
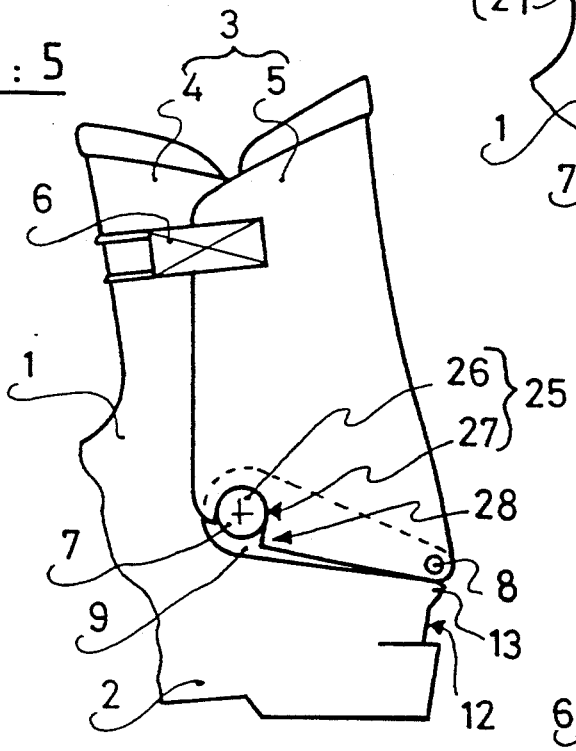

In FIG. 5, other blockage means 25 of rear spoiler 5 in the closure position of upper 3 are constituted by the end 26 of linkage axis 7 of the stirrup on shell base 1 and by a cut-out 27 formed in the lower edge 28 of wing 23 of rear spoiler 5. In this embodiment, rear spoiler is thus retained in the closed position of upper 3 by blockage against axis 7 which is likewise its front flexion pivot axis.

The blockage means 20–25 for blocking pivoting of rear spoiler 5 around its double journal 7–8 with respect to the front portion 4 of upper 3 which have just been described with reference to FIGS. 4 and 5 serve only as abutments towards the front for the spoiler 5, the latter being retained towards the rear only by means of closure 6 of the upper.

According to other possible embodiments, the blockage means can, on the other hand, likewise participate in the retention and pivoting towards the rear of rear spoiler 5.

Figure 6:
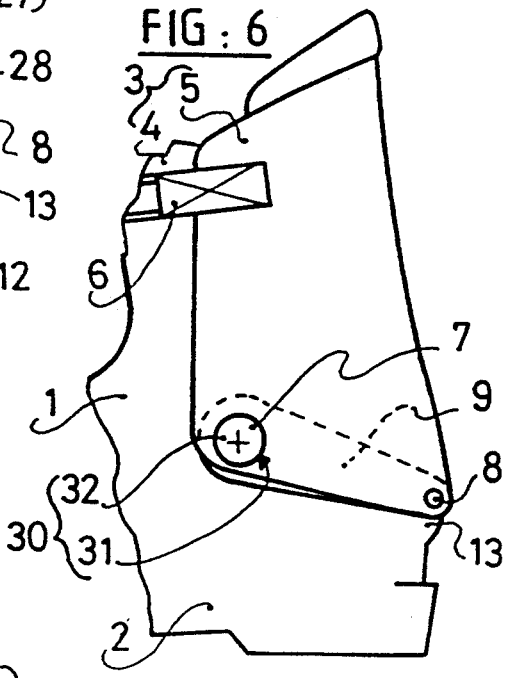
Figure 7:
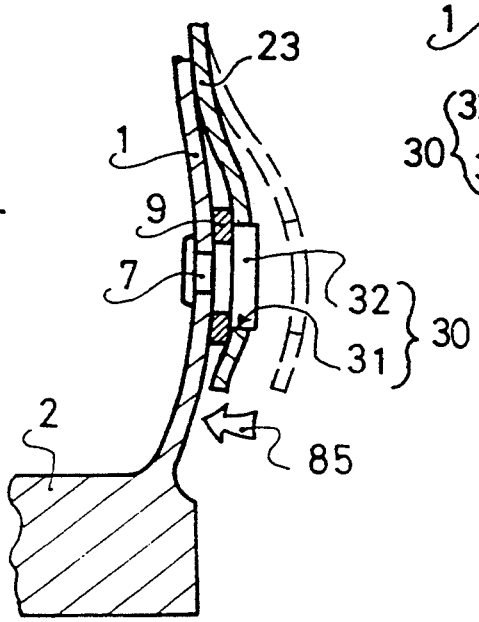

Thus in embodiment shown in FIGS. 6 and 7, the blockage means 30 used to retain, rear-to-front spoiler 5 intervene in the rear direction (front flexion), and in front-to-rear direction (rear support). To this end, the blockage means 30 are constituted by a perforation 31 obtained in wing 23 of the rear spoiler corresponding to the and 32 of linkage axis 7 and on which the perforation 31 nests (arrow 85), the linkage thus achieved acting in the manner of an elastic latch. It is to be understood that wing 23 of rear spoiler 5 is provided with a lower extension sufficient to totally cover axis 7 and which is elastically deformable in spacing to allow nesting (arrow 85) of the end 32 of axis 7 with perforation 31 which it carries.

It is self-evident that such a construction of the blockage means 30 can likewise be adapted to one type of boot such as that shown in FIG. 4. In effect, it suffices to replace the cut-out 21 with a perforation 31 in wing 23 of spoiler 5, in correspondence with plug 22 carried by the front portion 4 of the upper.

Figure 8:
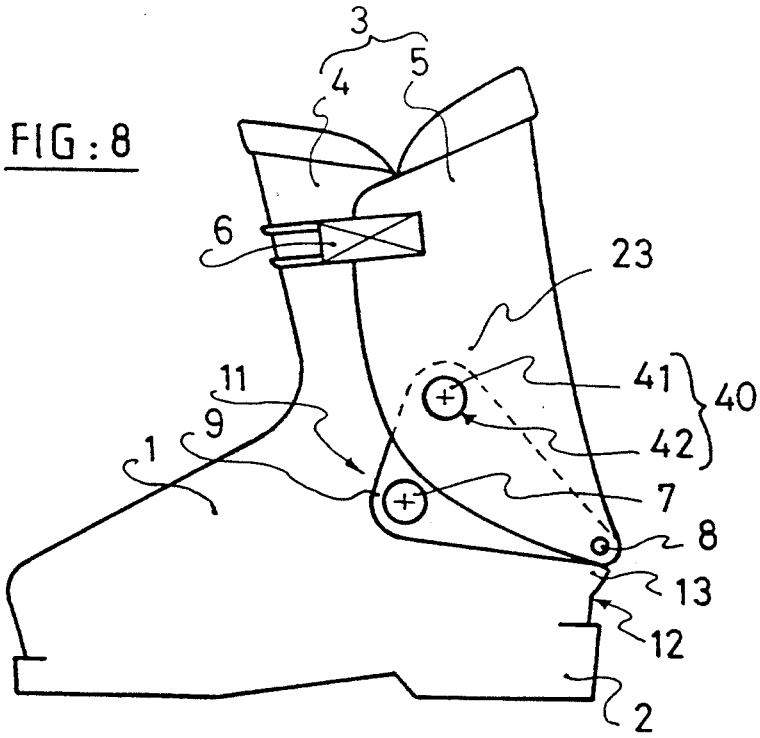

Furthermore, as illustrated in FIG. 8, the blockage means 40, of the "elastic blocking" type similar to those 30 described previously, are positioned between stirrup 9 and rear spoiler 5, at a distance from the journal axes 7 and 8 of the spoiler and the stirrup respectively on an upper extension 43 of stirrup 9 and on wing or lateral side 23 of spoiler 5. These blockage means 40 are constituted by a projection or plug 41 arranged on the stirrup and adapted to lodge itself in a hollow or opening 42 of a complementary shape to the projection, provided in the wall of wing 23 of spoiler 5. Rear spoiler 5 thus retained on stirrup 9 by blocking means is adapted to pivot in frontward flexion only around the frontward axis 7 positioned in the journal zone 11 of the ankle as in the preceding examples of FIGS. 4–7 while being likewise blocked in the direction of a rearward displacement from the support position of stirrup 9 on the shell base.

It is evident, without going beyond the scope of the invention, that these blockage means 40 can be positioned at other locations than those which have just been described. They can in particular be positioned between the two axes 7 and 8 on stirrup 9.

Figure 9:
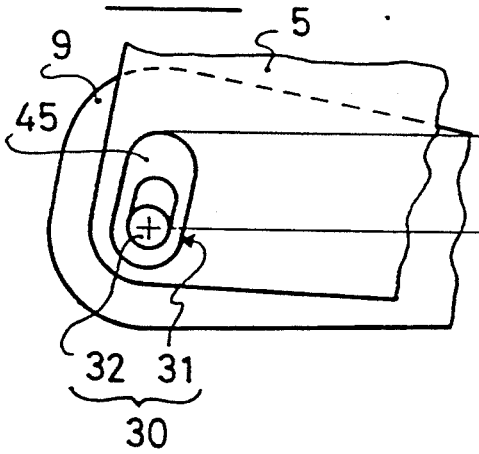
FIGS. 9–11 illustrate different apparatus for adjusting the respective position of the blockage means of the rear spoiler, either with respect to the front portion of the upper, or with respect to the pivot stirrup.
Figure 10:
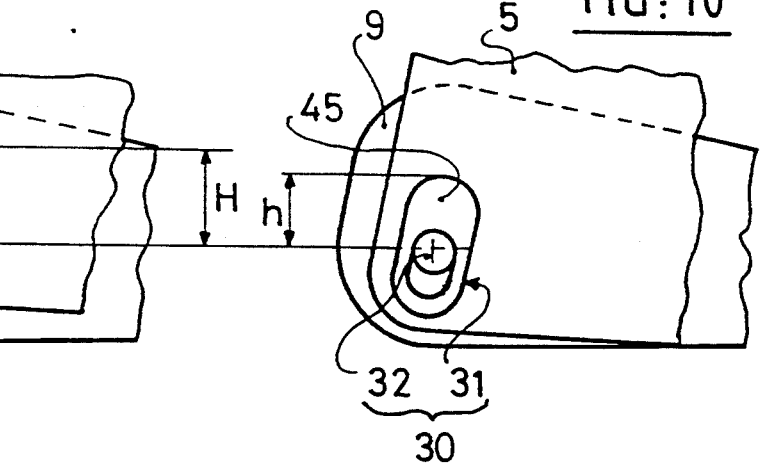

According to other embodiments, the blockage means of pivoting of the rear spoiler 5 can be made adjustable to different positions. Thus, it can be provided with a means for adjusting blockage either with respect to the front portion 4 of upper 3, or with respect to stirrup 9. FIGS. 9 and 10 illustrate one embodiment of a known adjustment apparatus for the blockage means 30 and 40 of the rear spoiler 5 of the boots illustrated respectively in FIGS. 6 to 8. This adjustment apparatus does not require being discussed again. It need only be remembered that the axis which serves as a reference for such an adjustment apparatus can as desired be constituted by the end 32 of linkage axis 7, by plug 41 or by plug 22, and that the seat of the adjustment element 45 can be one of the openings 31 or 41, it being understood that these openings are of a shape corresponding to the adjustment element 45.

Figure 11:
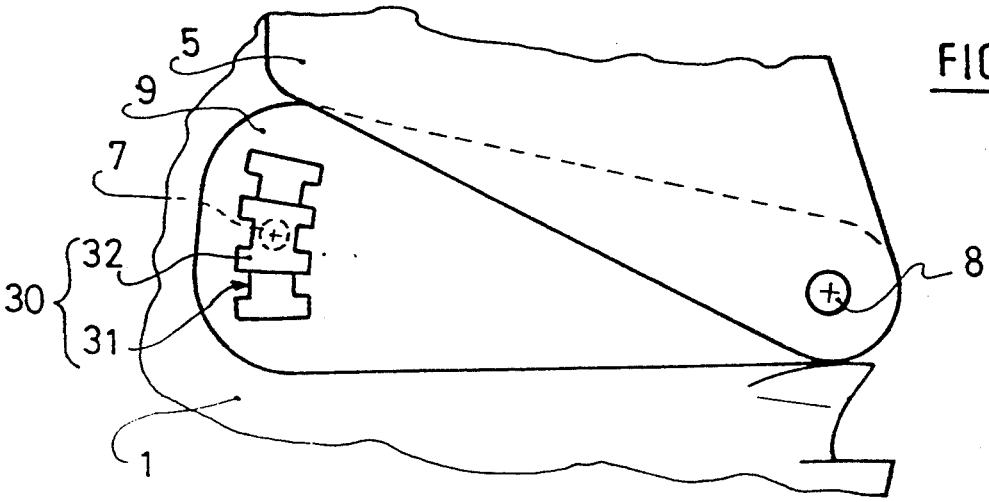

FIG. 11 illustrates another embodiment of a "tooth" adjustment apparatus. In this embodiment, opening 31 is present in the form of an elongated slot which includes teeth along its edges, which which similarly shaped end 32 is engageable and positionable. The slot is concentric to the pivot axis 8 of the rear spoiler 5.

The adjustment means can be associated as desired with the blockage means or with the pivot means of the upper, such as axis 7 for example. Depending upon the embodiment selected, it is possible to position as desired the projecting portion on one or the other of the elements present. Thus, FIG. 11 illustrates more precisely an apparatus for adjusting by means of the aforementioned teeth, making it possible to modify the position of the stirrup on the shell base of the boot. In this case, projection 32 is of a shape complementary to teeth 31 of the toothed slot 30, while projection 32 constitutes the pivoting end of axis 7 allowing for the flexional rotation of the upper.

Still according to the invention, the support element 13 of stirrup 9 on shell base 1 defining the "low" position of the stirrup can likewise be made adjustable in height or cooperate with an adjustment apparatus. Thus, for example, in FIG. 12, a removable wedge 50 of a certain thickness is interposed between the stirrup or its axis 8 and the support element 13. It is thus easy to modify the relative position and the height of axis 8 with respect to front axis 7 as a function of the thickness of the wedge selected and thus to modify correspondingly, the "low" position of stirrup 9 with respect to shell base 1.

According to the embodiment of FIG. 13, support element 55 is itself adjustable in height. To this end, support element 55 is carried by cursor 59 having teeth which can be immobilized in height on shell base 1 by means of a nut 56 and bolt 57 assembly and a succession of teeth complementary to those of the cursor, provided on the shell base. In this embodiment, the range of adjustment in height of the cursor is determined by the length of an oblong opening 60 with which it is provided and across which passes the nut 56. Preferably, a stop element 58 is associated with cursor 59, at a distance from the support element 55. The space between these stop and support elements 58 and 55 respectively, fixes the limits of amplitude of movement of axis 8 of stirrup 9 pivoting around its front axis 7, and thus the amplitude of vertical movement of rear spoiler 5. Such an arrangement makes it possible to guarantee an amplitude of flexion which is always constant in the low position of the opening axis 8 of rear spoiler 5.

According to the embodiment of FIGS. 13*a* and 13*b*, the rear spoiler 5 cooperates directly on cursor 59 through an abutment element such as a transverse edge 65 with which it is provided in the zone of its lower rear edge and which engages between the stop element 58 and support element 55 when the rear spoiler 5 is connected to the front cuff or spoiler 4 in the closure position of upper 3 and the skiing position. In this embodiment the rear spoiler 5 is connected to stirrup 9 in the form of a cap by means of two coaxial half-axes 8, which are lateral to the adjustment cursor 59, which allows its displacement in the vertical direction between the support element 55 and the stop element 58 by pivoting on the front axis 7 of stirrup 9.

As has been explained with reference to the preceding drawings, rear spoiler 5 is provided with a possibility of pivoting on the front of the boot and turning on the front axis 7 of linkage with stirrup 9 with shell base 1. As a result, rear spoiler 5 can follow the upper 3 of the boot through all of its flexional movements, as long as it is connected with the front portion 4 of the upper.

In a complementary fashion, the boot according to the invention can be controlled by a flexion control (FIGS. 1 and 2). This flexion control apparatus can then without going beyond the scope of the invention, be provided at the level of stirrup 9, and can even be an integral part of the stirrup.

To this end, FIG. 14 illustrates a stirrup comprising an apparatus for controlling flexion 70. This apparatus has a flexible front extension 70' in the form of a half buckle which extends from one to the other side of the linkage axis 7 while going around and being supported on an abutment 72 of shell base 1 in the zone corresponding substantially to the instep. Thus, when rear spoiler 5 is pivotably biased with respect to front axis 7, its opening axis 8 is moved upwardly and the flexible extension 70' which is supported on shell base 1 elastically opposes this flexional movement more or less. It is evident that the resistance in flexion of extension 70' is a function of its mechanical characteristics as well as its configuration, and that it will be defined by a rear-to-front force which is predetermined for this type of boot.

Furthermore, according to another embodiment (FIG. 15), extension 70' can preferably cooperate with a support abutment 71 which is adjustable in position and interposed between the extension 70' and the shell base 1. It is thus permissible for the skier to modify at will the value of the resistance to flexion of extension 70', while playing on the position of abutment 71 and thus to modify the rear-to-front force necessary to produce at the level of upper 3 to allow for the pivoting of the latter. Other equivalent embodiments are likewise possible. By way of example, in FIG. 16, stirrup 9 comprises an extension 70' which is simply frontwardly directed from the zone of the journal axis 7, without covering the zone of the instep. With this extension 70' cooperates a support abutment 71 which is movable and adjustable in translation the length of an abutment 72 positioned on the shell base 1. It is obvious that flexible extension 70' of stirrup 9 can thus extend towards the rear of shell base 1, from the front axis 7.

Figure 17:
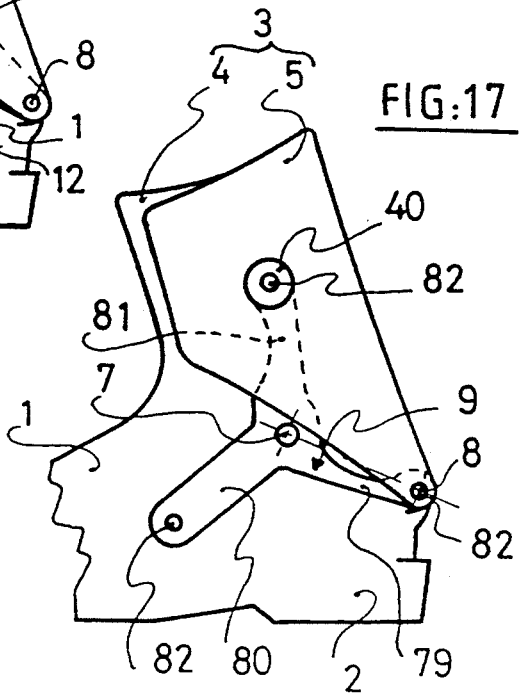
Figure 17A:
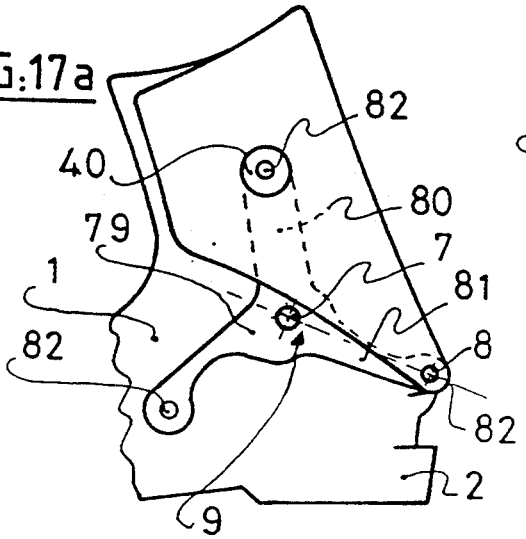

On the hand, FIG. 17 and 17*a* teach a particular embodiment of stirrup 9 assuring, on the one hand, the connection of the two journal axes 7–8 of rear spoiler 5 with respect to shell base 1 and, on the other hand, the retention of rear spoiler 5 in the closed position of upper 3 whose flexional control is assured while pivoting around the front axis 7. To this end, stirrup 9 comprises three extensions 79–80–81 which are likewise centered on axis 7. These extensions define together with the stirrup a sort of star having three arms distributed at about 120° whose center is constituted by the axis 7 and of which each end comprises a linkage means extension 82 of an identical nature for each of the three arms. Thus, by virtue of this identical nature of the connection means 82, they serve equally as a linkage for the opening axis 8 of rear spoiler 5, for the plug 41 of the blockage means 40, and for shell base 1. Furthermore, each arm 79, 80 and 81 of the star thus defined is obtained with particular shapes and provisions, such as relatively thin material for example, to have different flexional resistance characteristics. Thus, depending upon the resistance force and/or the control of the flexion desired at the level of the upper 3, the star is oriented around its central axis 7, then immobilized in rotation on shell base 1 through the arm not subjected to the upper, as is respectively illustrated for two positions made possible by this type of construction (FIGS. 17 and 17*a*).

Each arm 79, 80 or 81 defines a resistance to flexion which is more or less great with respect to the two others. It will therefore suffice for a low force to connect the arm 79, which is most flexible to the shell base 1 (FIG. 17*a*) or, furthermore, for a more elevated force, to affix arm 80, which is most resistant to flexion, to this same shell base (FIG. 17). In the example shown in FIG. 17*a*, the weakest arm is that 79 of the stirrup. It will be noted that depending upon the orientation of the star, it is those of arms 79, 80 or 81 which connect the front axis 7 to the opening axis 8 which constitutes the stirrup itself, as is clear from the description which has preceded.

Figure 18:
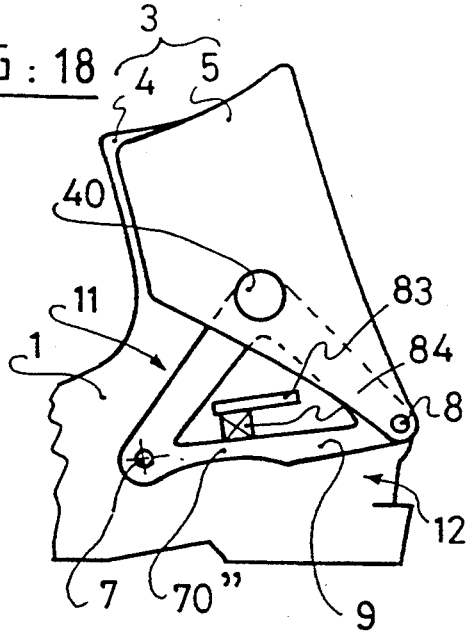

Still according to the invention, stirrup 9, according to the embodiment of FIG. 18, is substantially defined in the form of a sort of triangle whose apices are constituted by blockage means 40, axis 7 and axis 8. The two sides of this triangle defined, respectively, between axis 7 and means 40, then between means 40 and axis 8, are non-deformable, while the side defined between axis 7 and axis 8 has a flexional zone 70'', which is comprises, for example, a relatively thin portion, i.e., a portion having a reduced width. An edge 83 provided on shell base 1, substantially above the side of flexible zones 70'' of stirrup 9 serves as an abutment and guide for cursor 84. This cursor is interposed in an adjustment manner between the edge 83 and zone 70'' of stirrup 9. Thus, during a flexion of upper 3 frontwardly, rear spoiler 5 tends to rise in the zone of heel 12 and to move its opening axis 8 in an upward direction and against the flexional resistance of zone 70'' of stirrup 9. It follows that the relative position of cursor 84 with respect to axis 7 correspondingly defines the flexional force necessary for the elastic deformation of zone 70'' of stirrup 9 and that it is thus possible to vary the value of the forces to control the upper 3 in front flexion.

Figure 18A:
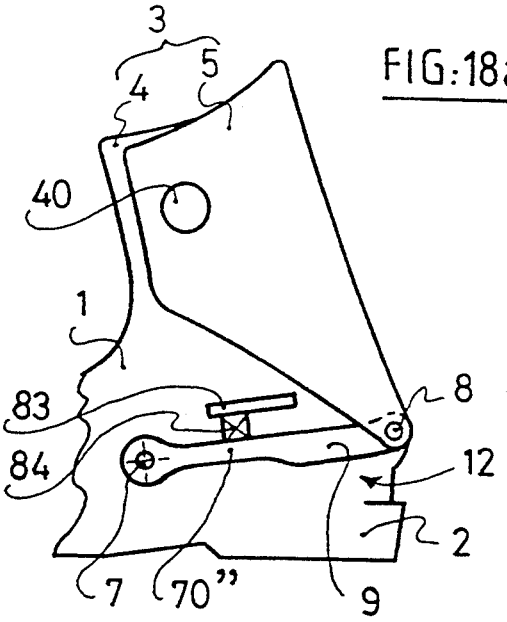

According to another embodiment (FIG. 18*a*), stirrup 9 extends simple from front axis 7 to opening axis 8, a flexional zone 70'' being positioned between these two axes. In this embodiment, rear spoiler 5 is retained in the closed position on the front portion 4 of the upper through blockage means 40. The flexional control of upper 3 is obtained in a manner similar to that of the example of FIG. 18, in particular in that an edge 83 extending from shell base 1 serves as a support for a cursor 84, whose position is adjustable the length of flexional zone 70'' of stirrup 9, constituted by a single arm on each of the sides of the shell base.

Figure 19:
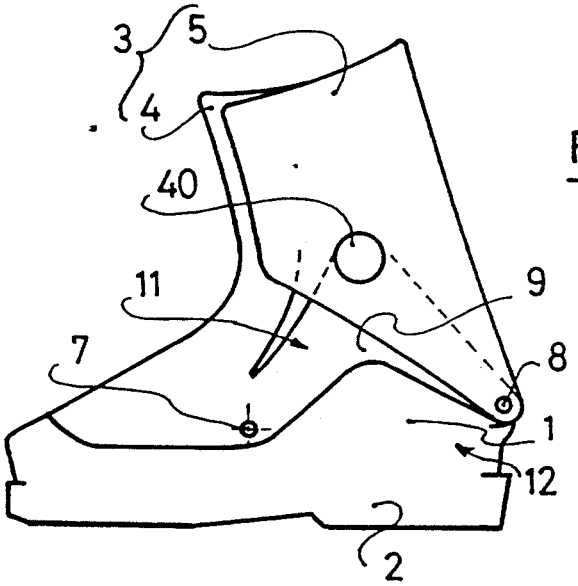

Finally, of all the examples previously described, a stirrup 9 independent from the other constituent parts of the boot has been described. It is however possible, without going beyond the scope of the invention, to provide a stirrup 9 either in the form of an extension of the wall extending from the shell base 1, or extending from an extension of the wall of the front portion 4 of the upper 3. By way of example, FIG. 19 illustrates an embodiment of a stirrup 9 constituted by a low extension (directed from front to rear) of this front portion 4 extending until the opening axis 8 and positioned in the zone of heel 12. Here again, stirrup 9 can be made as desired with or without retention means 40 of rear spoiler 5 in the closure position of upper 3.

In the description of the ski boot according to the invention there has been no mention made of the particular configuration of the front portion 4 of upper 3 with respect shell base 1 because, this can equally be made pivotable as desired with respect to shell base 1 either around an axis belonging to itself or around the same front axis 7 of stirrup 9, or further simply comprise a flexible zone.

Furthermore, the front pivot axis 7 of stirrup 9, and consequently of rear spoiler 5 in the direction of frontward flexion of upper 3 is preferably positioned in the zone 11 corresponding substantially to the position of the journal of the ankle. It can, however, be provided in front of this zone particularly in the case of construction illustrated with reference to FIGS. 18 and 18*a*. In effect, in these examples, the pivot axis of the upper towards the front is defined by the relative position of cursor 84 the length of the flexible zone 70' of stirrup 9 and is thus the guide edge 83 of cursor 84 which is positioned in this journal zone 11.

Finally, the two side plates of stirrup 9 adjacent to the sides of the boot are connected between them in the zone of heel 12 as has previously been described either by means of opening axis 8 obtained from a single piece, or by means of two half-axes 8 and of the rear spoiler 5 which thus forms the linkage between the side plates (FIG. 13*b*). These side plates can preferably be connected between them by a "linkage zone" substantially in the form of a half buckle or arc going around the zone of heel 12, this zone being able to be formed from one piece with side plates or applied thereon by known assembly means.

This application claims the priority of French Application 90 01101 filed Jan. 26, 1990, the disclosure of which is hereby incorporated by reference thereto.

Finally, although the invention has been described with reference to particular means, materials and embodiments, it is to be understood that the invention is not limited to the particulars disclosed and extends to all equipments within the scope of the claims.

What is claimed:

1. A ski boot comprising:

a shell base;

an upper comprising a front portion and a rear spoiler;

a stirrup extending along opposite lateral sides of the shell base at least from an ankle area of a wearer of the boot to a rear portion of the boot;

means for pivotally connecting the stirrup to the shell base at a first axis, whereby the stirrup is mounted for a predetermined amount of movement with respect to the shell base in a heel area of the boot, the first axis being located generally in the ankle area;

means for pivotally connecting the rear spoiler to the stirrup at a second axis, the second axis being located rearwardly of the first axis substantially at the rear end of the heel area of the boot, whereby the rear spoiler is rearwardly pivotal with respect to the stirrup and with respect to the front portion of the upper for insertion and removal of a foot with respect to the boot; and means for limiting downward movement of the stirrup, the means for limiting downward movement of the stirrup comprising at least one support element located at the rear portion of the boot.

2. A ski boot according to claim 1, wherein:

said stirrup includes a boot insertion and removal position and said at least one support element is located on said shell base, whereby a portion of said stirrup engages with said at least one support element in said foot insertion and removal position.

3. A ski boot according to claim 2, wherein:

said rear spoiler comprises a lower rear edge, said lower rear edge comprising an abutment, said abutment being engageable with said at least one support element in said foot insertion and removal position of said stirrup.

4. A ski boot according to claim 2, further comprising:

means for adjusting the height of said at least one support element on said shell base.

5. A ski boot according to claim 4, wherein:

said upper includes a closed position, said boot further comprising at least one stop element for limiting upward movement of said stirrup around said first axis, while said upper is in said closed position.

6. A ski boot according to claim 5, wherein:

said stirrup comprises a rear portion and said at least one stop element is engageable with said rear portion of said stirrup for limiting upward movement of said stirrup.

7. A ski boot according to claim 6, wherein:

said means for pivotally connecting the rear spoiler to the stirrup at a second axis comprises a pivot axle along which said second axis extends, wherein said pivot axle is engageable with said rear portion of said stirrup for limiting upward movement of said stirrup.

8. A ski boot according to claim 3, further comprising:

means for adjusting the height of said at least one support element on said shell base, wherein said upper comprises a closed position, wherein said boot further comprises at least one stop element for limiting upward movement of said stirrup around said first axis, while said upper is in said closed position, and wherein said at least one stop element is engageable with said abutment of said lower rear edge of said spoiler.

9. A ski boot according to claim 8, further comprising:

means for adjusting the height of said at least one stop element on said shell base.

10. A ski boot according to claim 5, wherein:

said at least one support element and said at least one stop element are a unitary piece.

11. A ski boot according to claim 1, further comprising:

means for blocking said rear spoiler with respect to said stirrup, said blocking means being located between said rear spoiler and said front portion of said upper.

12. A ski boot according to claim 1, further comprising:

means for blocking said rear spoiler with respect to said stirrup, said blocking means being located between said rear spoiler and said stirrup.

13. A ski boot according to claim 12, wherein:

said blocking means are located at said first axis.

14. A ski boot according to claim 13, wherein:

said means for pivotally connecting the stirrup to the shell base at a first axis comprises at least one pivot axle, said at least one pivot axle having an exterior end, said rear spoiler comprising at least one lateral side, said at least one lateral side having a cavity within which said exterior end of said at least one pivot axle extends, said cavity and said exterior end having respective complementary shapes.

15. A ski boot according to claim 11, wherein:

said stirrup comprises an upward extension and wherein said blocking means are located on said upward extension of said stirrup.

16. A ski boot according to claim 11, wherein:

said stirrup comprises an upward extension, said upward extension forming a part of said blocking means, other parts of said blocking means being carried by said rear spoiler.

17. A ski boot according to claim 15, wherein:

constituent elements of said blocking means comprise at least one projecting element and one opening having respective complementary shapes.

18. A ski boot according to claim 16, wherein:

constituent elements of said blocking means comprise at least one projecting element and one opening having respective complementary shapes.

19. A ski boot according to claim 11, further comprising:

means for adjusting the location of said blocking means with respect to said shell base.

20. A ski boot according to claim 1, wherein:

said stirrup comprises means for controlling flexion of said upper with respect to said shell base.

21. A ski boot according to claim 20, wherein:

said means for controlling flexion comprises a flexible portion of said stirrup, said flexible portion of said stirrup extending at least forwardly of said first axis.

22. A ski boot according to claim 21, further comprising:

a support abutment on said shell base, wherein said flexible portion of said stirrup cooperates with said support abutment for controlling flexion of said upper.

23. A ski boot according to claim 20, further comprising:

a support abutment on said shell base, wherein said means for controlling flexion comprises a relatively thinned portion of said stirrup extending between said first axis and said second axis, wherein thinned portion of said stirrup cooperates with said support abutment for controlling flexion of said upper.

24. A ski boot according to claim 15, wherein:

said stirrup comprises three arms radiating from and being distributed around said first axis, a first of said three arms extending generally rearwardly to said second axis for connecting said stirrup to said rear spoiler, a second of said three arms extending generally forwardly for connection to said shell base, and a third of said three arms extending generally upwardly for connection with said rear spoiler, said third of said three arms having an end forming a part of said blocking means.

25. A ski boot according to claim 1, wherein:

said stirrup comprises a portion extending unitarily from said front portion of said upper rearwardly to said second axis.

26. A ski boot according to claim 1, wherein:

said stirrup comprises a portion extending unitarily from a forward portion said shell base rearwardly to said second axis.

* * * * *